US006259100B1

(12) United States Patent
Cross

(10) Patent No.: US 6,259,100 B1
(45) Date of Patent: Jul. 10, 2001

(54) MULTIPLE GAP PHOTO-ELECTRIC SENSOR USING LIGHT PIPES

(75) Inventor: James W. Cross, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/299,520

(22) Filed: Apr. 26, 1999

Related U.S. Application Data

(60) Provisional application No. 60/083,083, filed on Apr. 27, 1998.

(51) Int. Cl.[7] ..... G01N 9/04

(52) U.S. Cl. ..... 250/375; 356/375

(58) Field of Search ..... 250/559.12, 559.4, 250/227.24, 223 R, 221, 222.1, 216; 356/375, 387

(56) References Cited

U.S. PATENT DOCUMENTS 5,260,564 * 11/1993 Bruggeling et al. ..... 250/223 R 5,585,645 * 12/1996 Goto ..... 250/559.12

* cited by examiner

*Primary Examiner*—Stephone B. Allen
(74) *Attorney, Agent, or Firm*—Mark T. Starr

(57) ABSTRACT

An optical sensor for detecting a document moving along a document path. The invention provides at least two light paths across the document path, so that the document breaks at least one of the light paths as it moves along the document path, and this broken light path indicates the presence of the document. In an exemplary embodiment, the optical sensor comprises a photo-emitter that emits light across the document path to provide the first light path. A first reflector is optically coupled to the photo-emitter, and receives and reflects the light emitted by the photo-emitter. At least a second reflector is optically coupled to the first reflector to receive the light from the first reflector and to reflect that light across the document path to provide the second data path. A photo-detector is disposed across the light path from the second reflector and is optically coupled to the second reflector. The photo-detector is operable to detect the presence of the document by detecting when the document has broken at least one of the light paths.

15 Claims, 6 Drawing Sheets

MULTIPLE GAP PHOTO-ELECTRIC SENSOR USING LIGHT PIPES

This application claims benefit to U.S. provisional application Ser. No. 60/083,083, filed Apr. 27, 1998.

BACKGROUND

Description of Related Art

Contemporary document handling systems have an ongoing need to detect when documents are present in one or more document-handling tracks associated with such handling systems. Typically, it is important to detect the presence of a document as a precursor to some further activity, such printing on the document, scanning the document, or performing some other function on the document.

Some document handling systems use light emitter/detector pairs to detect when a document is present. Such emitter-detector pairs have been arranged in at least two configurations. First, the emitter and detector can be mounted on opposing sides of the document path, so that the emitter transmits a light beam across the document path directly to the detector. Second, the emitter and detector can be mounted on the same side of the document path, with a mirror or other reflector mounted on the opposite side of the path to optically couple the emitter and the detector. In either case, the light beam as emitted, reflected, and detected provides a normally-closed light "circuit", which is broken or opened by an opaque document, thereby indicating the presence of the document.

Electronic circuitry is connected to the detector to determine when light is reaching the detector. When a document passes along the track between the emitter and detector, the document breaks the beam and opens the normally-closed light "circuit," thereby alerting the electronic circuitry that a document is present and is ready for whatever processing is necessary.

One design issue with such handling systems is how best to detect documents having variable dimensions. If all the documents that will be handled by the system are substantially the same size, then one standard arrangement of the emitter, detector, and reflector will suffice for all the documents. However, more typical document handling systems may have to detect documents having various dimensions. In this case, the "one size fits all" arrangement described above may not detect certain smaller documents. Specifically, if the emitter-detector pair is located in the center of the width of the document path, then smaller documents may pass on either side of the pair and escape detection.

One solution to this problem is to increase the resolution of the detector circuit by providing additional emitter-detector pairs that monitor the document path at certain intervals. However, this approach, while perhaps effective at detecting smaller documents, introduces substantial additional cost into the design and manufacture of the document handling system. Specifically, this additional cost includes the cost of the added emitters and detectors themselves, along with the cost of the circuitry necessary to interface these additional emitters and detectors to the rest of the system. Further, these additional emitters, detectors, and interface circuitry take up more physical space, further complicating the design and manufacture of the entire system.

Accordingly, there is a need in the art for an optical sensor capable of detecting variably sized documents without the added expense of more emitter-detector pairs or interface circuitry.

SUMMARY

The present invention addresses the above need in the art by providing an optical sensor for detecting a document moving along a document path. The invention provides at least two light paths across the document path, so that the document breaks at least one of the light paths as it moves along the document path, and this broken light path indicates the presence of the document. In an exemplary embodiment, the optical sensor comprises a photo-emitter that emits light across the document path to provide the first light path. A first reflector is optically coupled to the photo-emitter, and receives and reflects the light emitted by the photo-emitter. At least a second reflector is optically coupled to the first reflector to receive the light from the first reflector and to reflect that light across the document path to provide the second data path. A photo-detector is disposed across the light path from the second reflector and is optically coupled to the second reflector. The photo-detector is operable to detect the presence of the document by detecting when the document has broken at least one of the light paths.

Additional features and advantages of the present invention will become evident hereinafter.

BRIEF DESCRIPTION OF THE DRAWINGS

The foregoing summary, as well as the following detailed description of exemplary embodiments, is better understood when read in conjunction with the appended drawings. For the purpose of illustrating the invention, the drawings show several exemplary embodiments, it being understood, however, that the invention is not limited to the specific methods and instrumentalities disclosed. In the drawings.

DETAILED DESCRIPTION OF EXEMPLARY EMBODIMENTS

Figure 1:
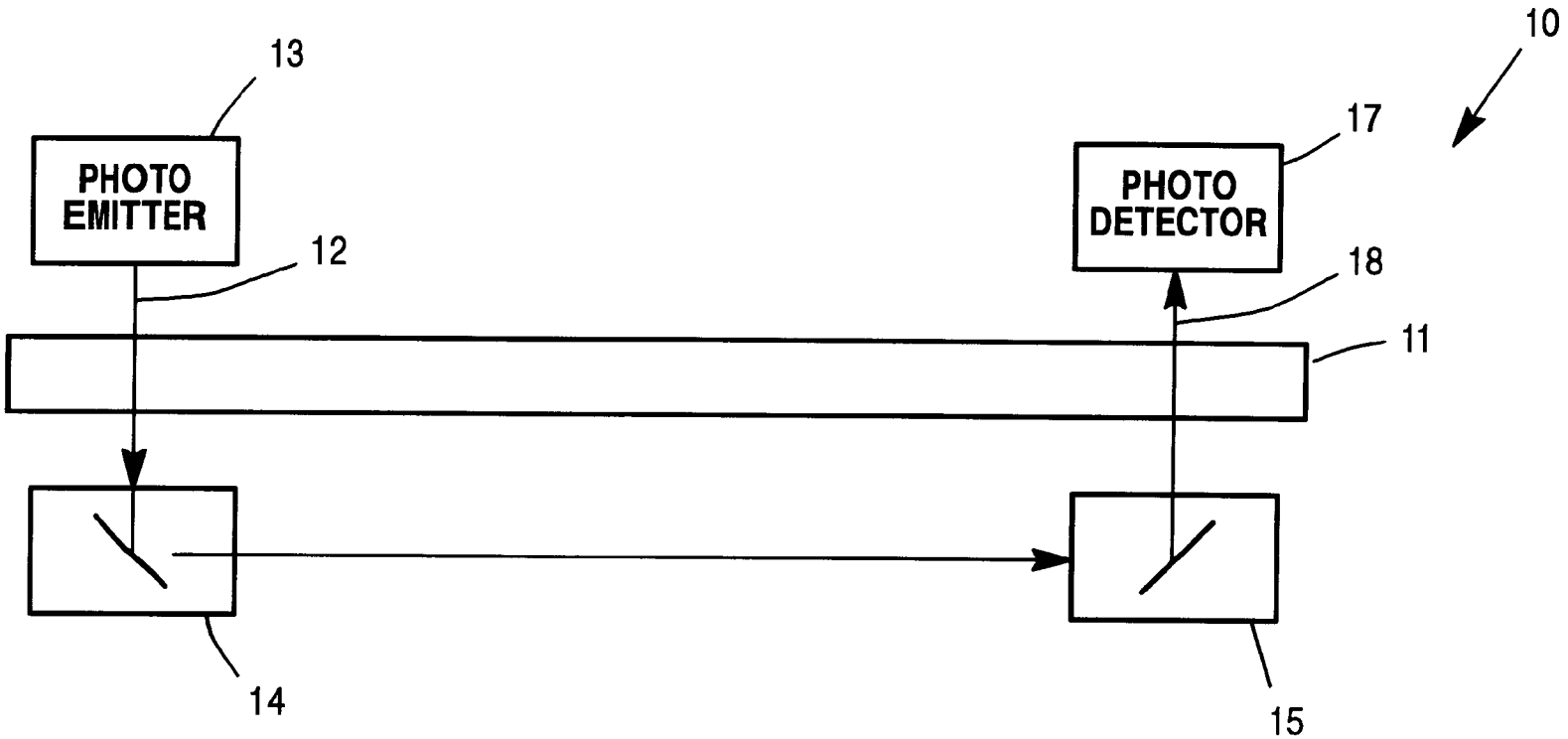
FIG. 1 is a diagram of an optical sensor constructed according to an exemplary embodiment of the ion.

Referring to the drawings, wherein like numerals represent like elements throughout, there is shown in FIG. 1 a diagram of an optical sensor 10 constructed according to an exemplary embodiment of the invention. The optical sensor 10 detects a document (not shown) moving along a document path 11. All of the drawings provide an end view of document path 11, such that the documents moving along the document path 11 travel in a line normal to the plane of the paper. Thus, the documents would travel into or out of the paper. The invention provides at least two light paths 12 across the document path 11, so that the document breaks at least one of the light paths 12 as it moves along the document path 11, and this broken light path indicates the presence of the document. In an exemplary embodiment, the optical sensor 10 comprises a photo-emitter 13 that emits light across the document path 11 to provide the first light path 12. A first reflector 14 is optically coupled to the photo-emitter 13, and receives and reflects the light emitted by the photo-emitter 13. At least a second reflector 15 is optically coupled to the first reflector 14 to receive the light from the first reflector 14 and to reflect that light across the document path 11 to provide the second data path 18. A photo-detector 17 is disposed across the light path 11 from the second reflector 15 and is optically coupled to the second reflector 15. The photo-detector is operable to detect the presence of the document by detecting when the document has broken at least one of the light paths 12 or 18.

The optical sensor 10 shown in FIG. 1 is most suitable where the photo-emitter 13 is a high intensity emitter, or when the emitter 13 has a low angle of emission where dispersion losses would be minimized. Exemplary emitters 13 having these characteristics are lasers and laser diodes.

Figure 2:
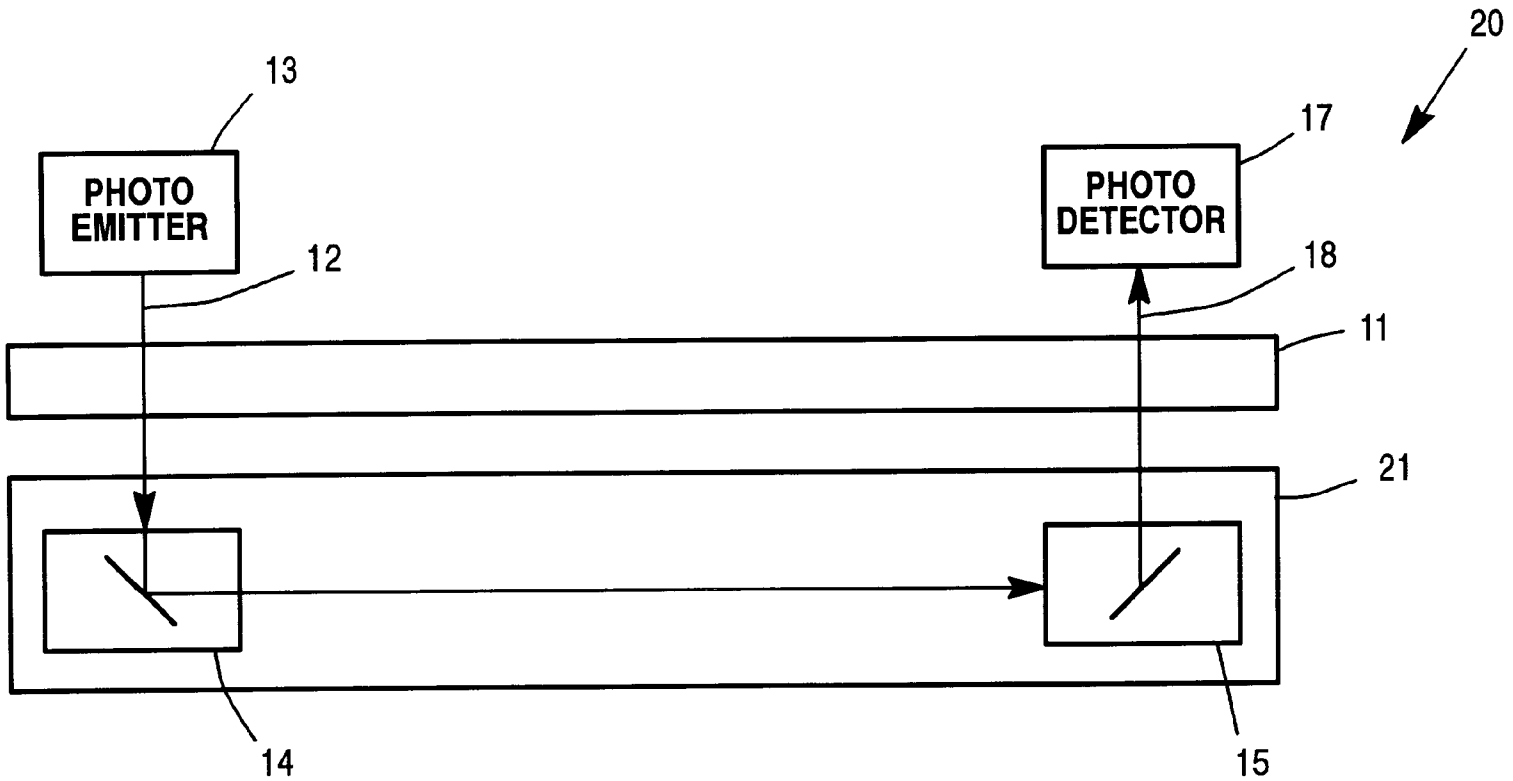
FIG. 2 is a diagram of an optical sensor constructed according to a further exemplary embodiment of the invention, illustrating the use of a light pipe containing reflectors.

FIG. 2 is a diagram of an optical sensor 20 constructed according to a further exemplary embodiment of the invention, illustrating the use of a light pipe 21 containing reflectors 14 and 15. Such an arrangement might be suitable where the emitter 13 does not have the intensity or emission characteristics outlined above in FIG. 1. In this case, the light pipe 21 serves to focus or channel the light from the emitter 13. The first reflector 14 and the second reflector 15 can be housed or otherwise contained within the light pipe 21.

Figure 3:
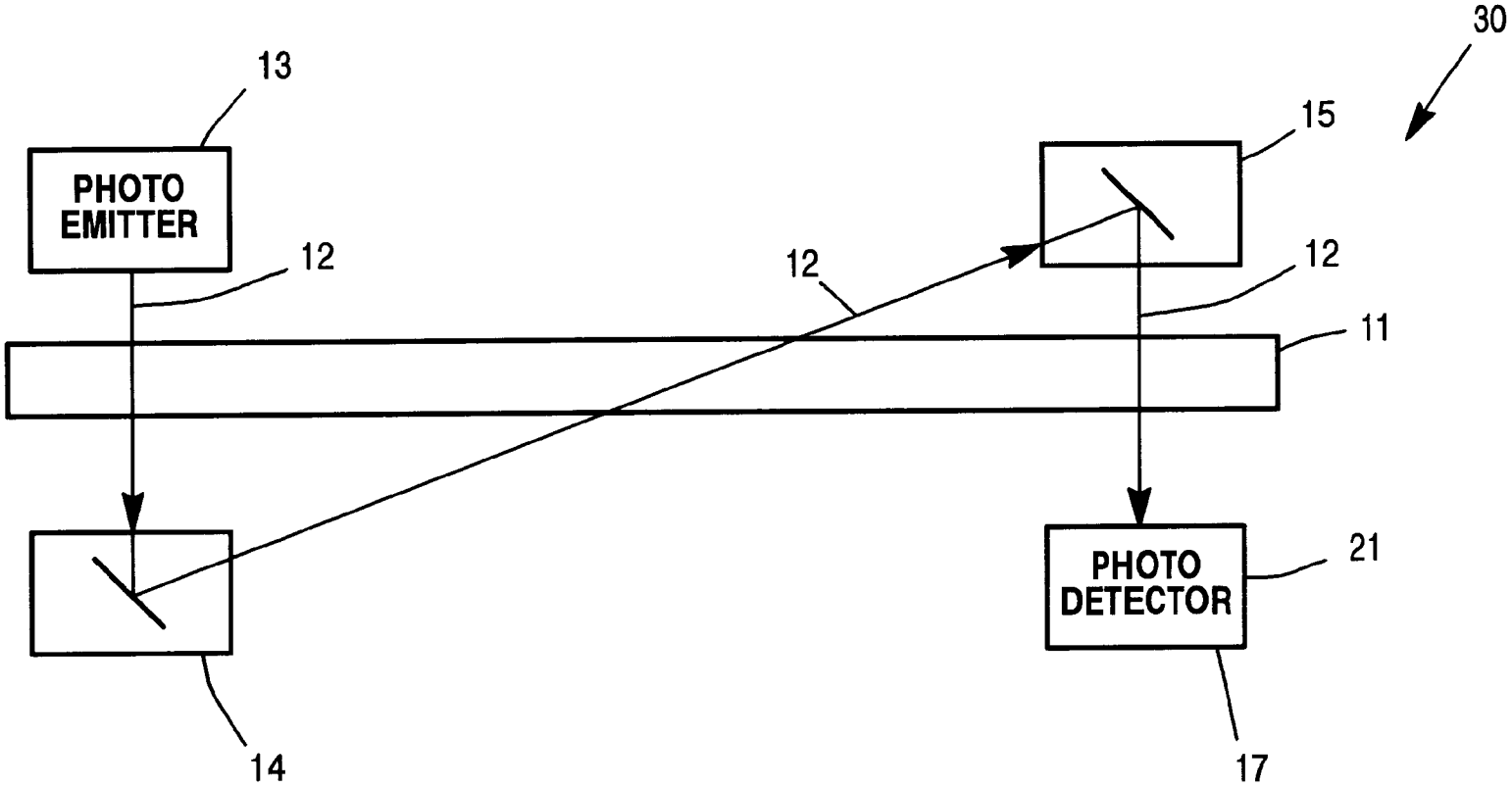
FIG 3 is a diagram of an optical sensor constructed according to a further embodiment of the invention, illustrating a variant configuration of the embodiment shown in FIG. 1.

FIG. 3 is a diagram of an optical sensor 30 constructed according to a further embodiment of the invention, illustrating a variant configuration of the embodiment shown in FIG. 1. According to this further exemplary embodiment of the invention, the photo-emitter 13 and the photo-detector 17 can be disposed on opposites sides of the document path 11, and the first reflector 14 and the second reflector 15 can be disposed on opposites sides of the document path 11. This arrangement can provide additional light paths 12 across the document path 11 without additional reflectors 14 or 15 or emitter/detector pairs. However, fabricating reflectors 14 and 15 disposed at precise acute angles as shown in FIG. 3 can be relatively costly as compared to fabricating reflectors 14 and 15 disposed at right angles as shown in FIGS. 1 and 2. Also, the embodiments shown in FIGS. 1 and 2 allow the wiring associated with both the emitter 13 and detector 17 to be routed on the same side of the document path 11. Further, in applications where the optical sensor may be installed in harsh environments such as high heat and/or high humidity, the embodiments shown in FIGS. 1 and 2 allow for only the emitter and detector side of the document track needing protection from the environment. However, these advantages are lost when the emitter 13 and detector 17 are on opposite sides of the document path 11. Nevertheless, if wire routing, cost of fabrication, and alignment and/or harsh environments are not issues in a specific application, then the embodiment shown in FIG. 3 may be suitable.

Figure 4:
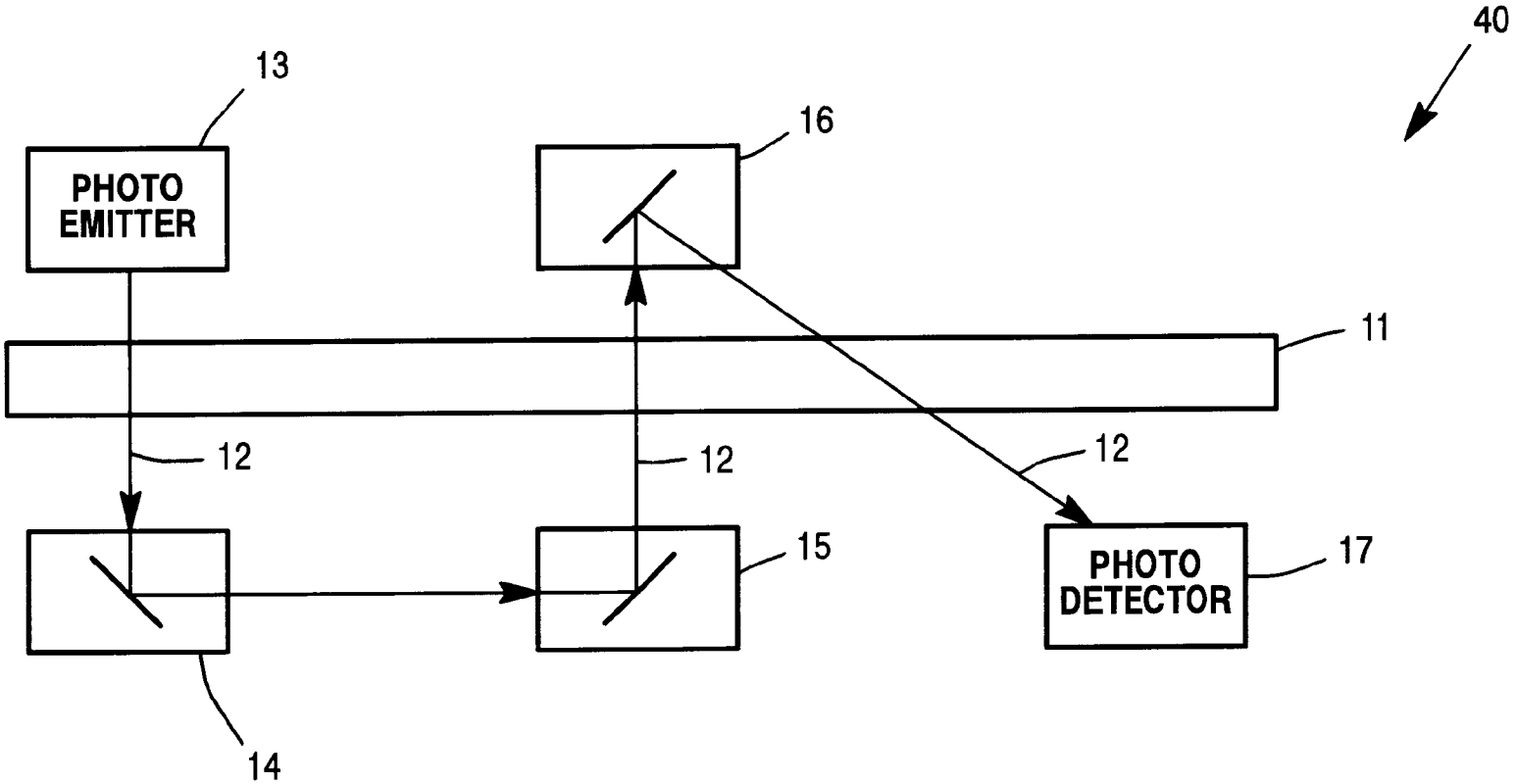
FIG. 4 is a diagram of an optical sensor constructed according to a further embodiment of the invention, illustrating a further variant configuration of the embodiment shown in FIG. 1.

As shown in FIG. 4, the optical sensor 40 provides one or more additional, further reflectors 16 that optically couple the second reflector 15 to the photo-detector 17. If only one further reflector 16 is provided, that one further reflector 16 is placed across the document path 11 from the photo-detector 17 to receive the light and reflect it across the document path 11 to the photo-detector 17, thereby providing at least a third light path 12. If more than one further reflector 16 is provided, then a first one of those further reflectors 16 is optically coupled directly to the second reflector 15, and a last one of those further reflectors 16 is optically coupled directly to the photo-detector 17. Zero or more additional reflectors 16 can be coupled between the first and last further reflectors 16. Specifically, if N further reflectors 16 optically couple the second reflector 15 to the photo-detector 17, where N is an even integer>=2, the N further reflectors 16 can be arranged to provide N/2 further light paths 12 across the document path 11. These additional light paths 12 improve the resolution of the optical sensor 40, and provide the sensor 40 with additional sensor gaps to detect documents of varying widths travelling along the document path 11, without added emitters 13, detectors 17, or associated interface circuitry.

Figure 5:
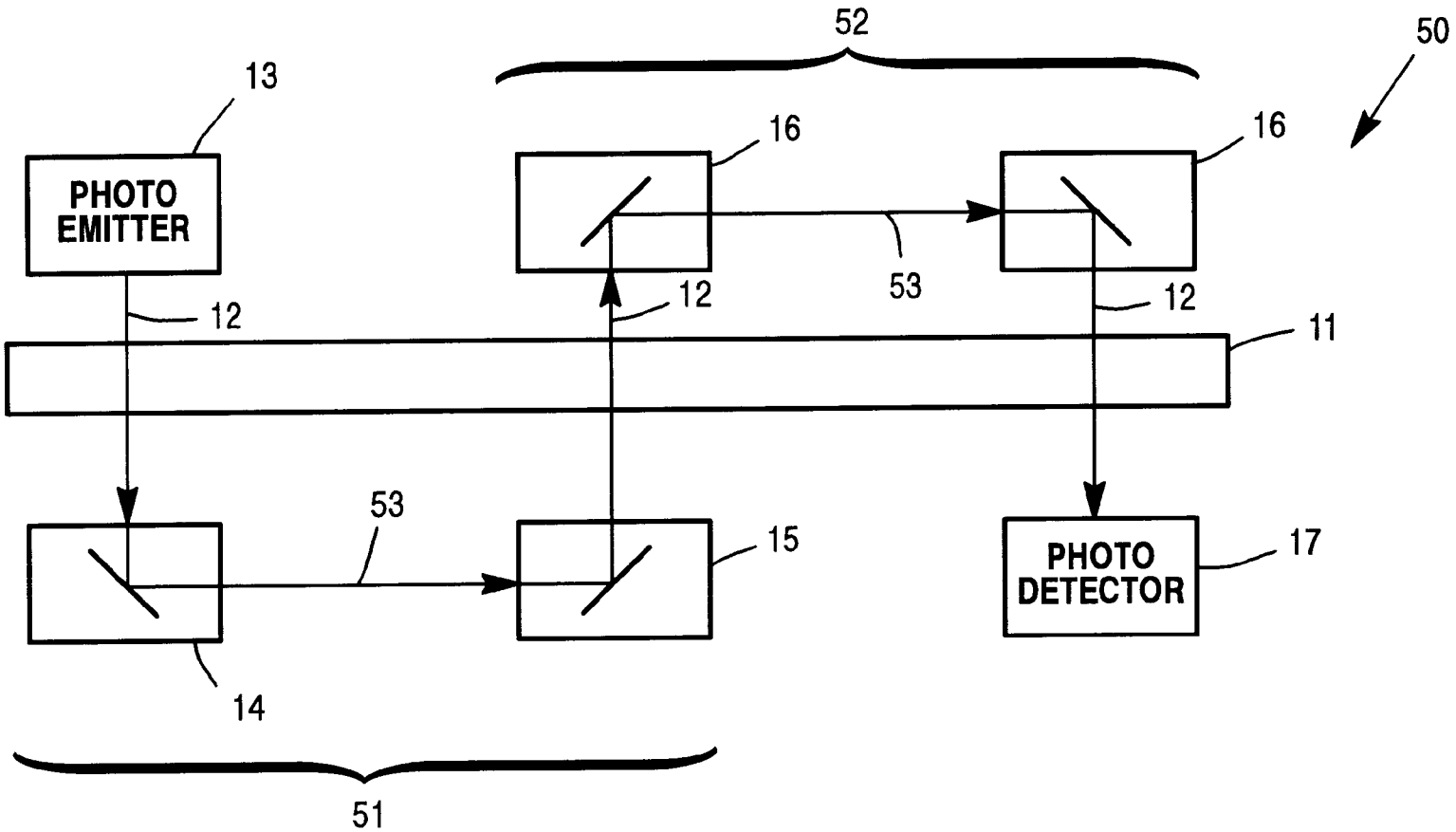
FIG. 5 is a diagram of an optical sensor constructed according to a further embodiment of the invention, illustrating a further variant configuration of the embodiment shown in FIG. 1.

As shown in FIG. 5, in an additional exemplary embodiment, the optical sensor 50 can be constructed to arrange the first and the second reflectors 14 and 15 collectively in a reflector pair 51, with the reflector pair 51 disposed across the document path 11 from the photo-emitter 13. The first reflector 14 receives the light from the photo-emitter 13 and reflects the light to the second reflector 15. Additionally, the N further reflectors 16 described above can be arranged in N/2 reflector pairs as represented by an exemplary reflector pair 52. The second reflector 15 can reflect the light to a the reflector pair 52, and each one of the reflector pairs 51 and 52 can be disposed on alternating sides of the document path 11 to provide N/2 light paths 12 across the document path 11, thereby improving the resolution of the optical sensor 50.

As also shown in FIG. 5, for each one of the reflector pairs 51 and 52, a path 53 traveled by the light passing between the two reflectors 14, 15 and 16 comprising reflector pairs 51 and 52 may be substantially parallel to the document path 11. This construction may promote a compact design for the overall optical sensor 50. Further, the term "substantially" is used here to indicate that the path 53 between the reflectors in the reflector pair need not be absolutely parallel to the document path 11 in a mathematical sense. Instead, some variations from parallel may occur because of application requirements, manufacturing constraints, or other factors. It is also to be understood that this construction is not essential or necessary to practicing the invention.

Extending this exemplary embodiment, the optical sensor 50 can include N further reflectors 16 optically coupling the second reflector 15 to the photo-detector 17, where N is an integer>=2. The N further reflectors 16 can be arranged individually to provide N further light paths 12 across the document path 11. More specifically, a first one of the N further reflectors 16 can be disposed across the document path from the second reflector 15, and the rest of the N further reflectors 16 can be disposed on alternating sides of the document path 11 to provide N further light paths 12 across the document path 11. As discussed above, this and the other exemplary arrangements of the reflectors provide additional light paths, thereby improving the resolution of the optical sensor.

Figure 6:
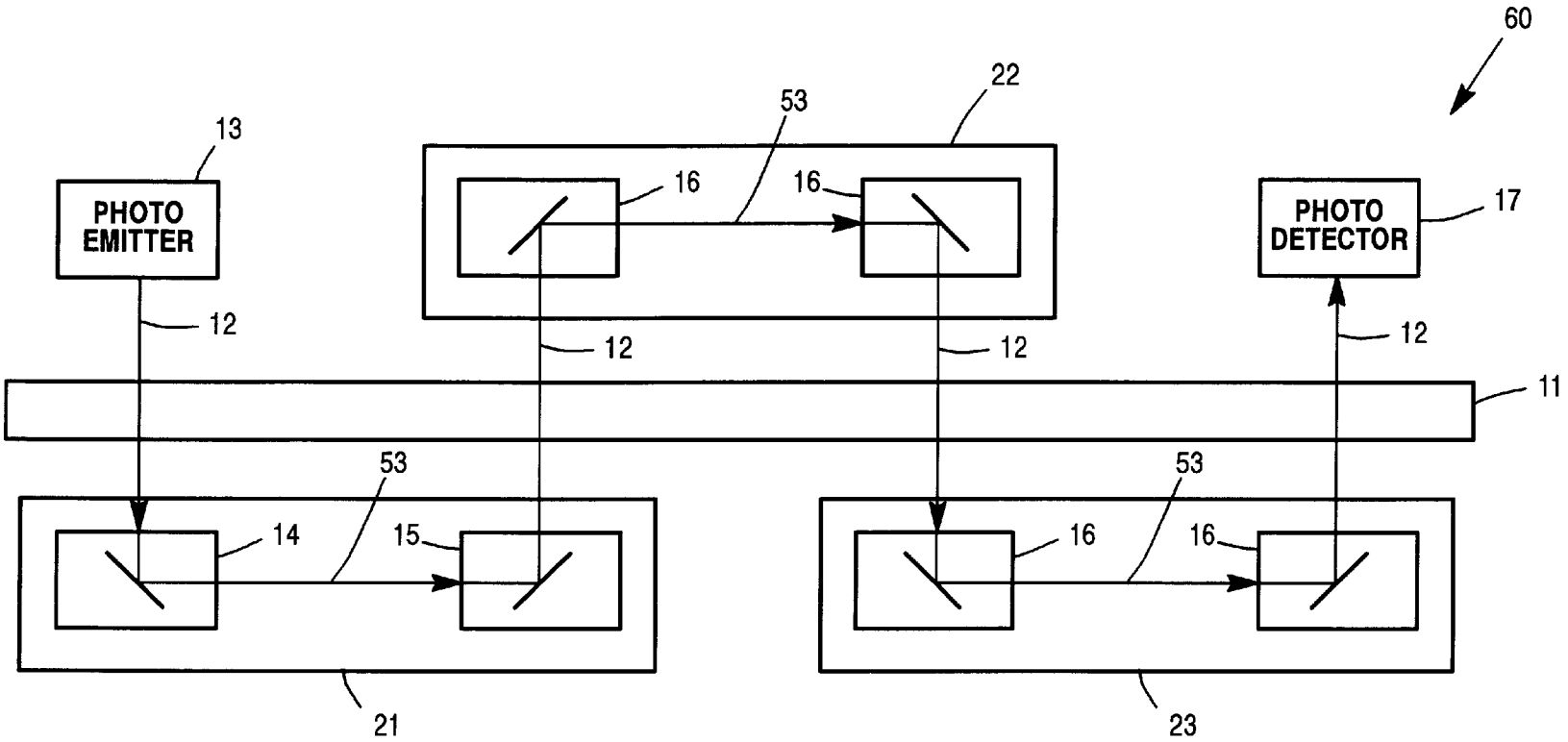
FIG. 6 is a diagram of an optical sensor constructed according to a further embodiment of the invention, illustrating the use of several light pipes.

FIG. 6 is a diagram of an optical sensor 60 constructed according to a further embodiment of the invention, illustrating the use of several light pipes 21 housing the reflectors 14, 15 and 16. This embodiment provides an optical sensor 60 for detecting a document moving along a document path 11 by providing at least two light paths 12 across the document path 11. The optical sensor 60 constructed according to this embodiment can include at least a first and a second reflector 14 and 15 housed in the light pipe 21. The first reflector 14 receives light from the photo-emitter 13, while the second reflector 15 is optically coupled to the first reflector 14 to pass the light out of the light pipe 21 and on to the photo-detector 17 or to the next light pipe 22.

The optical sensor 60 can include at least a second light pipe 22 optically coupling the light pipe 21 to the photo-detector 17. The second light pipe 22 receives the light from the light pipe 21 and reflects it across the document path 11 to provide a third light path 12. In this embodiment, if only light pipes 21 and 22 are provided, the photo-detector 17 would be disposed across the light path 11 from the second light pipe 22 to receive the light from the second light pipe 22. However, this arrangement might place detector 17 and emitter 13 on opposite sides of the light path 11.

More generally, the optical sensor 60 can include N further light pipes, such as light pipe 23, optically coupling the light pipes 21 and 22 to the photo-detector 17, where N is for example an integer>=2. The N further light pipes 23 are arranged to provide N further light paths 12 across the document path 11. Specifically, the light pipe 21 and each one of the N further light pipes 22 and 23 can be disposed on alternating sides of the document path 11 to provide N further light paths 12 across the document path 11. As discussed above, the further light paths 12 provide additional resolution for the optical sensor 60. As also discussed above, the paths 53 traveled by the light within the light pipes 21, 22, 23 can be substantially parallel to the document path 11. Another alternate construction of FIG. 6 would be to substitute a light pipe shape like the letter "U" in place of light pipes 21 22 (with an up-side-down "U"), and 23 to N if the application allowed the space. This would eliminate the need for the reflectors built-in to each end of the light pipe and hence reduce the cost of the light pipe.

It is understood that changes may be made to the embodiments described above without departing from the broad inventive concepts thereof. For example, different embodiments of the invention may be applicable under different circumstances. Also, although the above description discusses the detection of documents, the invention may be of use in detection other objects having variable dimensions. Accordingly, the present invention is not limited to the particular embodiments disclosed, but is intended to cover all modifications that are within the spirit and scope of the invention as defined by the appended claims.

What is claimed is:

1. An optical sensor for detecting a document moving along a document path by providing at least two light paths across the document path, the document breaking at least one of the light paths as it moves along the document path to indicate the presence of the document, the optical sensor comprising:

a photo-emitter emitting light across the document path to provide a first light path;

a first reflector optically coupled to the photo-emitter to receive and reflect the light emitted by the photo-emitter;

at least a second reflector optically coupled to the first reflector to receive the light from the first reflector and to reflect the light across the document path to provide a second light path;

a photo-detector disposed across the light path from the second reflector and optically coupled to the second reflector, the photo-detector operable to detect the presence of the document by detecting when the document has broken at least one of the light paths; and a further reflector optically coupling the second reflector to the photodetector, wherein the further reflector is across the document path from the photo-detector, the further reflector receiving the light and reflecting it across the document path to the photo-detector to provide at least a third light path.

2. The optical sensor of claim 1, wherein the photo-emitter and the photo-detector are disposed on a same side of the document path.

3. The optical sensor of claim 2, further comprising a light pipe housing the first reflector and the second reflector.

4. The optical sensor of claim 1, wherein the photo-emitter and the photo-detector are disposed on opposites sides of the document path.

5. The optical sensor of claim 1, wherein the first reflector and the second reflector are disposed on opposites sides of the document path.

6. The optical sensor of claim 1, further comprising N further reflectors optically coupling the second reflector to the photo-detector, where N is an even integer>=2, the N further reflectors arranged to provide N/2 further light paths across the document path.

7. The optical sensor of claim 6, wherein for each one of the reflector pairs, a path traveled by the light between the two reflectors comprising a given reflector pair is substantially parallel to the document path.

8. The optical sensor of claim 1, wherein the first and the second reflectors are arranged in a pair across the document path from the photo-emitter, wherein the first reflector receives the light from the photo-emitter and reflects the light to the second reflector, wherein the N further reflectors are arranged in N/2 reflector pairs, with the second reflector reflecting the light to a first one of the reflector pairs, and wherein each one of the reflector pairs are disposed on alternating sides of the document path to provide N/2 light paths across the document path.

9. The optical sensor of claim 1, further comprising N further reflectors optically coupling the second reflector to the photo-detector, where N is an integer>=2, and wherein the N further reflectors being arranged to provide N further light paths across the document path.

10. The optical sensor of claim 9, wherein a first one of the N further reflectors is disposed across the document path from the second reflector, and wherein the N further reflectors are disposed on alternating sides of the document path to provide N further light paths across the document path.

11. An optical sensor for detecting a document moving along a document path by providing at least two light paths across the document path, the document breaking at least one of the light paths as it moves along the document path to indicate the presence of the document, the optical sensor comprising:

a photo-emitter emitting light across the document path to provide a first light path;

a light pipe disposed across the light path from the photo-emitter and optically coupled to the photo-emitter to receive and reflect the light emitted by the photo-emitter across the document path to provide a second light path;

a photo-detector disposed across the light path from the light pipe and optically coupled to the light pipe, the photo-detector operable to detect the presence of the document by detecting when the document has broken at least one of the light paths; and at least a second light pipe optically coupling the light pipe to the photo-detector the second light pipe receiving the light from the light pipe and reflecting the light across the document path to provide a third light path, and wherein the photo-detector is disposed across the light path from the second light pipe to receive the light from the second light pipe.

12. The optical sensor of claim 11, further comprising at least a first and a second reflector housed in the light pipe, the first reflector receiving light from the photo-emitter, and the second reflector being optically coupled to the first reflector to pass the light to the photo-detector.

13. The optical sensor of claim 11, further comprising N further light pipes optically coupling the light pipe to the photo-detector, where N is an integer>=2, the N further light pipes arranged to provide N further light paths across the document path.

14. The optical sensor of claim 13, wherein the light pipe and each one of the N further light pipes are disposed on alternating sides of the document path to provide N further light paths across the document path.

15. The optical sensor of claim 11, wherein a path traveled by the light within the light pipe is substantially parallel to the document path.

* * * * *